US008550885B2

(12) United States Patent
Tanaka

(10) Patent No.: US 8,550,885 B2
(45) Date of Patent: Oct. 8, 2013

(54) GRINDER HAVING MECHANISM FOR REGULATING ROTATION OF WHEEL GUARD

(75) Inventor: Kazumi Tanaka, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 274 days.

(21) Appl. No.: 12/972,217

(22) Filed: Dec. 17, 2010

(65) Prior Publication Data

US 2011/0151757 A1 Jun. 23, 2011

(30) Foreign Application Priority Data

Dec. 21, 2009 (JP) ..... 2009-288845

(51) Int. Cl.
*B24B 55/05* (2006.01)

(52) U.S. Cl.
USPC ..... 451/451; 451/359

(58) Field of Classification Search
USPC ..... 451/359, 454, 455, 452, 451
See application file for complete search history.

(56) References Cited

U.S. PATENT DOCUMENTS

| | | | | |
|---|---|---|---|---|
| 7,063,606 | B2 * | 6/2006 | Stierle et al. | 451/359 |
| 7,927,191 | B2 * | 4/2011 | Esenwein | 451/451 |
| 7,955,162 | B2 | 6/2011 | Boeck et al. | |
| 8,221,197 | B2 | 7/2012 | Boeck et al. | |
| 8,231,436 | B2 * | 7/2012 | Boeck et al. | 451/344 |
| 8,282,446 | B2 * | 10/2012 | Sulea et al. | 451/451 |
| 2009/0019899 | A1 | 1/2009 | Boeck et al. | |
| 2009/0036044 | A1 | 2/2009 | Boeck et al. | |
| 2009/0098812 | A1 | 4/2009 | Boeck et al. | |
| 2010/0210195 | A1 | 8/2010 | Numata et al. | |
| 2010/0210196 | A1 | 8/2010 | Hosokawa et al. | |
| 2012/0231710 | A1 | 9/2012 | Boeck et al. | |

FOREIGN PATENT DOCUMENTS

| | | | |
|---|---|---|---|
| CN | 1852785 | A | 10/2006 |
| CN | 101534996 | A | 9/2009 |
| DE | 102006053305 | A1 | 5/2008 |
| JP | 2009-125841 | A | 6/2009 |
| WO | 2009/054274 | A1 | 4/2009 |

OTHER PUBLICATIONS

China Intellectual Property Office (SIPO) Office Action for application CN201010603204.6 (Mar. 5, 2013).

* cited by examiner

*Primary Examiner* — Robert Rose
(74) *Attorney, Agent, or Firm* — Kilpatrick Townsend & Stockton LLP

(57) ABSTRACT

A grinder includes a housing, a gear cover attached to the housing by a plurality of screws, a spindle case attached to the gear cover, a wheel guard rotatably mounted on the spindle case for covering approximately a half of a disc-shaped tool bit attached to a spindle, a stop piece that regulates the rotation of the wheel guard. The wheel guard is selectively fixed to and unfixed from the spindle case. The stop piece is fixed to the housing together with the gear cover by at least one of the plurality of screws. The stop piece has an abutting section at which the stop piece abuts the wheel guard to regulate the rotation of the wheel guard. The abutting section is located at a position deviated from an axial line of the at least one of the plurality of screws.

16 Claims, 9 Drawing Sheets

GRINDER HAVING MECHANISM FOR REGULATING ROTATION OF WHEEL GUARD

CROSS REFERENCE TO RELATED APPLICATION

This application claims priority from Japanese Patent Application No. 2009-288845 filed Dec. 21, 2009. The entire content of this priority application is incorporated herein by reference.

TECHNICAL FIELD

The present invention relates to a portable grinder having a rotation-regulation mechanism for regulating rotation of a wheel guard that prevents grinding dust and other dirt from scattering toward an operator.

BACKGROUND

There have been provided various disc grinders, and FIGS. 1 and 2 show an example of conventional disc grinders.

A disc grinder 101 shown in FIGS. 1 and 2 includes a motor housing 102, a gear cover 103 attached to the front section of the motor housing 102 by screws 115*a*, 115*b*, and the like, a spindle case 104 attached to the gear cover 103, and a spindle 107 rotatably supported to the spindle case 104. The motor housing 102 accommodates a motor (not shown) therein, and the gear cover 103 accommodates a power transmission mechanism (not shown) for transmitting rotation of the motor to the spindle 107.

The disc grinder 101 also includes a wheel guard 105 for preventing grinding dust and other dirt from scattering toward an operator during grinding operations. The wheel guard 105 is mounted on the spindle case 104 coaxially with the spindle 107 so as to cover over about a half of a tool bit (not shown) on the operator side as shown in FIG. 1. The wheel guard 105 is provided with a fastening unit including a fastening ring 106, a screw 108, and a nut 109. The fastening ring 106 is attached to the wheel guard 105 and formed with a pair of bending parts 106*a* and 106*b* at ends thereof. The screw 108 is inserted through screw holes formed in the bending parts 106*a* and 106*ba* and engages with the nut 109. The fastening unit selectively fixes and unfixes the wheel guard 105 to and from the spindle case 104. The operator can determine a desired angle position of the wheel guard 105 by taking a working posture and the like into consideration and rotate the wheel guard 105 about a rotary axis of the spindle 107 in its circumferential direction to the desired angle position as shown in FIG. 2, after unscrewing the screw 108 to loosen the fastening ring 106.

FIG. 3 shows another conventional disc grinder 101A having the wheel guard 105 mounted on a spindle case 204, which is attached to a gear cover 203.

FIG. 4 shows still another conventional disc grinder 101B disclosed in Japanese Patent Application-Publication No. 2009-125841. The disc grinder 101B includes the wheel guard 105 mounted on a spindle case 304, which is attached to a gear cover 303. The wheel guard 105 is selectively fixed to and unfixed from the spindle case 304 by a fastening unit having a fastening ring divided into a pair of ring members 306A and 306B in a circumferential direction of the wheel guard 105, a screw 308 and a nut 309 that connect between edges of the ring members 306A and 306B on one side, and a fingertip fastening mechanism that selectively connects and separates the other edge 306*a* of the ring member 306A to and from the other edge of the ring member 306B on the other side when a lever 369 is operated. When the lever 369 is moved in a radial direction of the wheel guard 105, then the fastening ring is loosened to make the wheel guard 105 rotatable with respect to the spindle case 304.

SUMMARY

The wheel guard 105 shown in FIG. 2 has been rotated in a counterclockwise direction D1 from a position of θ=0° shown in FIG. 1, where an edge 105*b* of the wheel guard 105 is on a line L1 (FIG. 1), to a position of θ=about 110 degrees. Note that the line L1 is perpendicular to an axial line L2 of the motor. The wheel guard 105 can rotate even further to a position of θ=360 degrees to make full circle. This is also the same with the configurations shown in FIGS. 3 and 4.

However, recent international standards for power tools require to adopt means for preventing a rear section of the tool bit on the operator side from being not covered by the wheel guard 105 when the wheel guard 105 accidentally comes free from a fixed position during operation by loose of the screw 108 or bumping on the wheel guard 105. Thus, it is now required to prevent the wheel guard 105 from rotating in the counterclockwise direction D1 beyond a predetermined position, which may be for example a position of θ=60 degrees, where the edge 105*b* of the wheel guard 105 is on a line L11 at 60 degrees from the line L1 (FIG. 2).

In view of the foregoing, it is an object of the invention to provide a grinder having a rotation-regulation mechanism for regulating a rotation angle of a wheel guard by using conventional components.

It is another object of the invention to realize the rotation-regulation mechanism only by addition a simple component so as to provide the grinder at minimum costs.

It is still another object of the invention to provide the grinder having the rotation-regulation mechanism without degrading operability of a position-adjustment function for the wheel guard.

In order to attain the above and other objects, the invention provides a grinder including a housing for accommodating a motor, a gear cover attached to the housing by a plurality of screws extending in a first direction, a spindle case attached to the gear cover, a spindle extending outward from the spindle case in a second direction perpendicular to the first direction, a wheel guard rotatably mounted on the spindle case for covering approximately a half of a disc-shaped tool bit attached to the spindle, and a stop piece that regulates the rotation of the wheel guard. The wheel guard is selectively fixed to and unfixed from the spindle case. The stop piece is fixed to the housing together with the gear cover by at least one of the plurality of screws. The stop piece has an abutting section at which the stop piece abuts the wheel guard to regulate the rotation of the wheel guard, and the abutting section is located at a position deviated from an axial line of the at least one of the plurality of screws that is extending in the first direction.

It is preferable that the spindle case have a column-shaped part, that the wheel guard include a fastening unit that selectively fixes and unfixes the wheel guard to and from an outer periphery of the column-shaped part of the spindle case, and that the abutting section abut the fastening unit of the wheel guard.

It is also preferable that the wheel guard also include a guard member, that the fastening unit include a fastening ring fixed to the guard member, and be formed with a protruding section protruding outward in a radial direction of the fastening ring, and that the abutting section abut the protruding section of the fastening unit.

It is further preferable that the protruding section include a screw and bending parts formed at both ends of the fastening ring and formed with screw holes through which the screw is inserted, and that the abutting section abut the screw.

It is preferable that the protruding section include a screw and bending parts formed at both ends of the fastening ring and formed with screw holes through which the screw is inserted, and that the abutting section abut one of the bending parts.

Alternatively, it is preferable that the fastening ring include a plurality of ring members, one of which is bent at one end to form a protrusion, and that the protruding section be the protrusion.

Alternatively, the stop piece may be fixed to the housing together with the gear cover by two of the plurality of screws.

In this case, it is preferable that the stop piece be formed by pressing a metal plate, and the abutting section is located between the two of the plurality of screws.

Still alternatively, the stop piece may be fixed by a single screw of the plurality of screws.

In this case, it is preferable that the stop piece be formed with a screw hole for receiving the one of the plurality of screws, and that the abutting section be located at a position deviated from the axial line of the one of the plurality of screws in a radial direction of the screw hole.

It is preferable that the housing be configured to accommodate the motor such that a rotary axis of the motor extends in the first direction, and that the gear cover be configured to accommodate a gear mechanism for transmitting a driving power of the motor to the spindle while reducing a rotation speed and changing a rotation direction by 90 degrees.

The invention also provides a grinder including a housing for accommodating a motor, a gear cover attached to one end of the housing in a first direction by a screw extending in the first direction, a spindle case attached to the gear cover, a spindle extending outward from the spindle case in a second direction perpendicular to the first direction, a wheel guard rotatably mounted on the spindle case, and a stop piece attached to the gear cover by the screw. The wheel guard is selectively fixed to and unfixed from the spindle case, and the stop piece has an abutting section. The wheel guard comes into abutment with the abutting section of the stop piece when the wheel guard is rotated to a predetermined position. The abutting section is located on a spindle side of the screw with respect to a third direction perpendicular to the first and second directions.

The invention also provides a grinder including a housing for accommodating a motor, a gear cover, two screws that attach the gear cover to one end of the housing in a first direction, a spindle case fixed to the gear cover, a spindle extending outward from the spindle case in a second direction perpendicular to the first direction, a wheel guard rotatably mounted on the spindle case, and a stop piece attached to the gear cover by the two screws and having an abutting section. The two screws extend in the first direction. The wheel guard is selectively fixed to and unfixed from the spindle case. The wheel guard comes into abutment with the abutting section of the stop piece when the wheel guard is rotated to a predetermined position. The two screws are aligned in a third direction perpendicular to the first and second directions. The abutting section is located between the two screws with respect to the third direction.

The invention also provides a grinder including a housing for accommodating a motor, a gear cover attached to one end of the housing in a first direction and formed with an exhaust opening, a spindle case attached to the gear cover, a spindle extending outward from the spindle case in a second direction perpendicular to the first direction, a wheel guard rotatably mounted on the spindle case, and a stop piece at least partially received in the exhaust opening. The wheel guard is selectively fixed to and unfixed from the spindle case. The stop piece has an abutting section that comes into abutment with the wheel guard when the wheel guard is rotated to a predetermined position.

The invention also provides a grinder including a housing for accommodating a motor, a gear cover fixed to one end of the housing in a first direction, a spindle case attached to the gear cover, a spindle extending outward from the spindle case in a second direction perpendicular to the first direction, a wheel guard rotatably mounted on the spindle case, and a stop piece. The wheel guard is selectively fixed to and unfixed from the spindle case. The stop piece is formed with a fixing section at which the top piece is fixed to the gear cover, an abutting section that comes into abutment with the wheel guard when the wheel guard is rotated to a predetermined position, and a reaction-force receiving section that is in abutment with the gear cover. The abutting section is located between the fixing section and the reaction-force receiving section with respect to a third direction perpendicular to the first and second directions.

The present invention also provides a grinder including a housing for accommodating a motor, a gear housing fixed to the housing, a spindle protruding outside the gear housing, a wheel guard rotatably supported to the gear housing, and a stopper provided to the gear housing. The stopper regulates rotation of the wheel guard.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
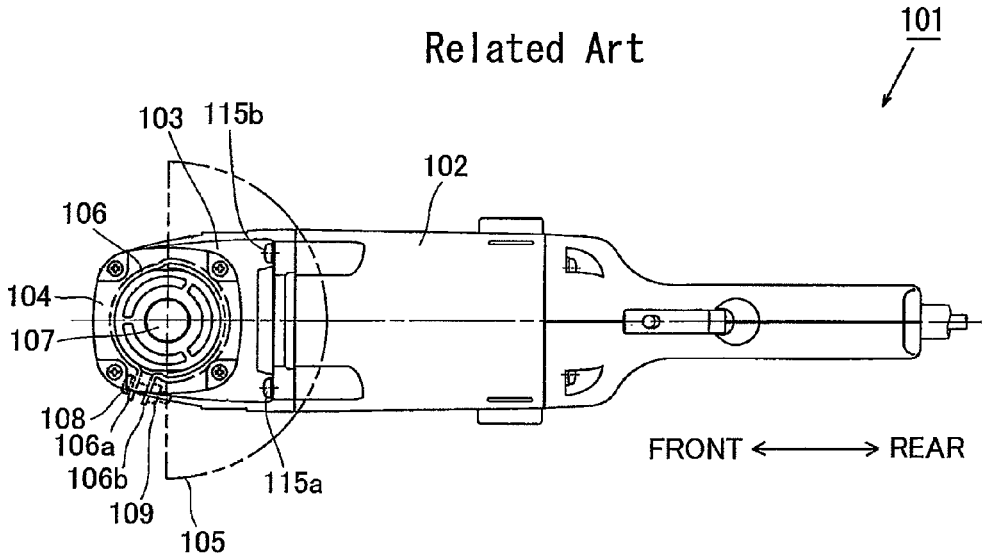
FIG.1 Related Art
FIG. 1 is a bottom view of a conventional disc grinder.
Figure 2:
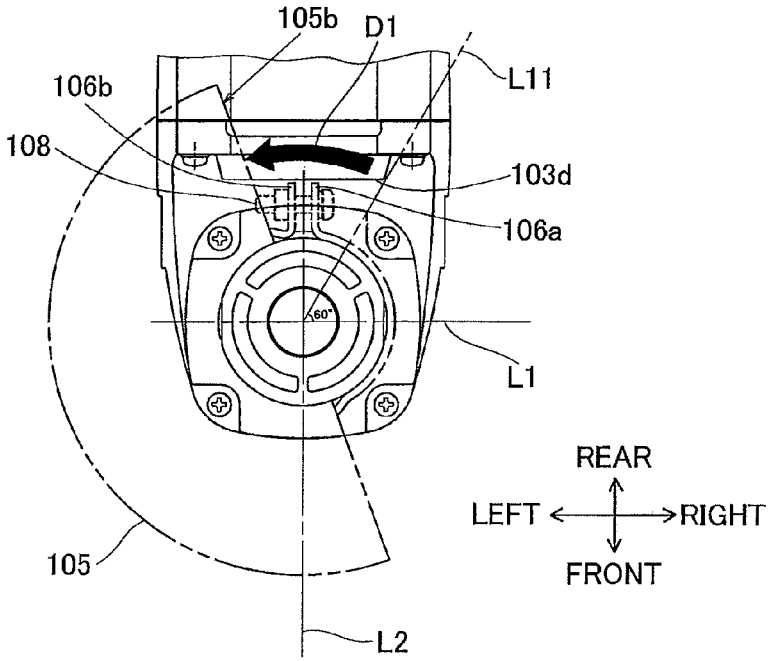
FIG.2 Related Art
FIG. 2 is an enlarged partial bottom view of the conventional disc grinder.
Figure 3:
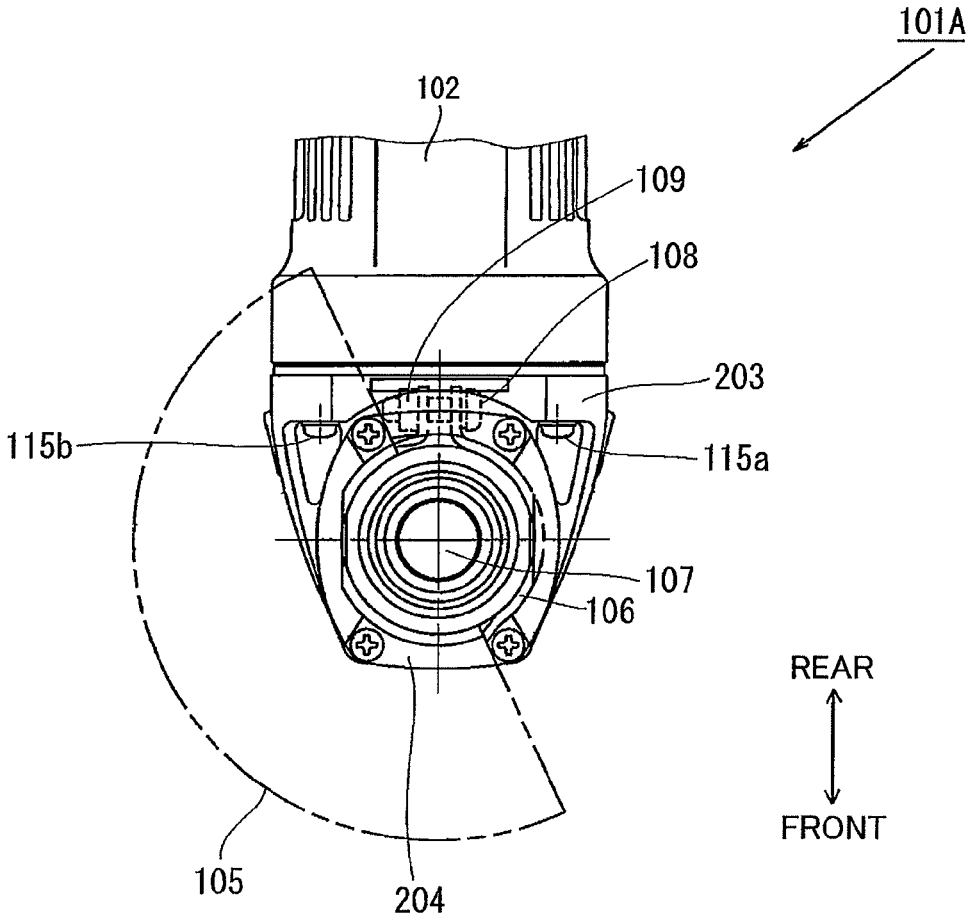
FIG.3 Related Art
FIG. 3 is a partial bottom view of another conventional disc grinder.
Figure 4:
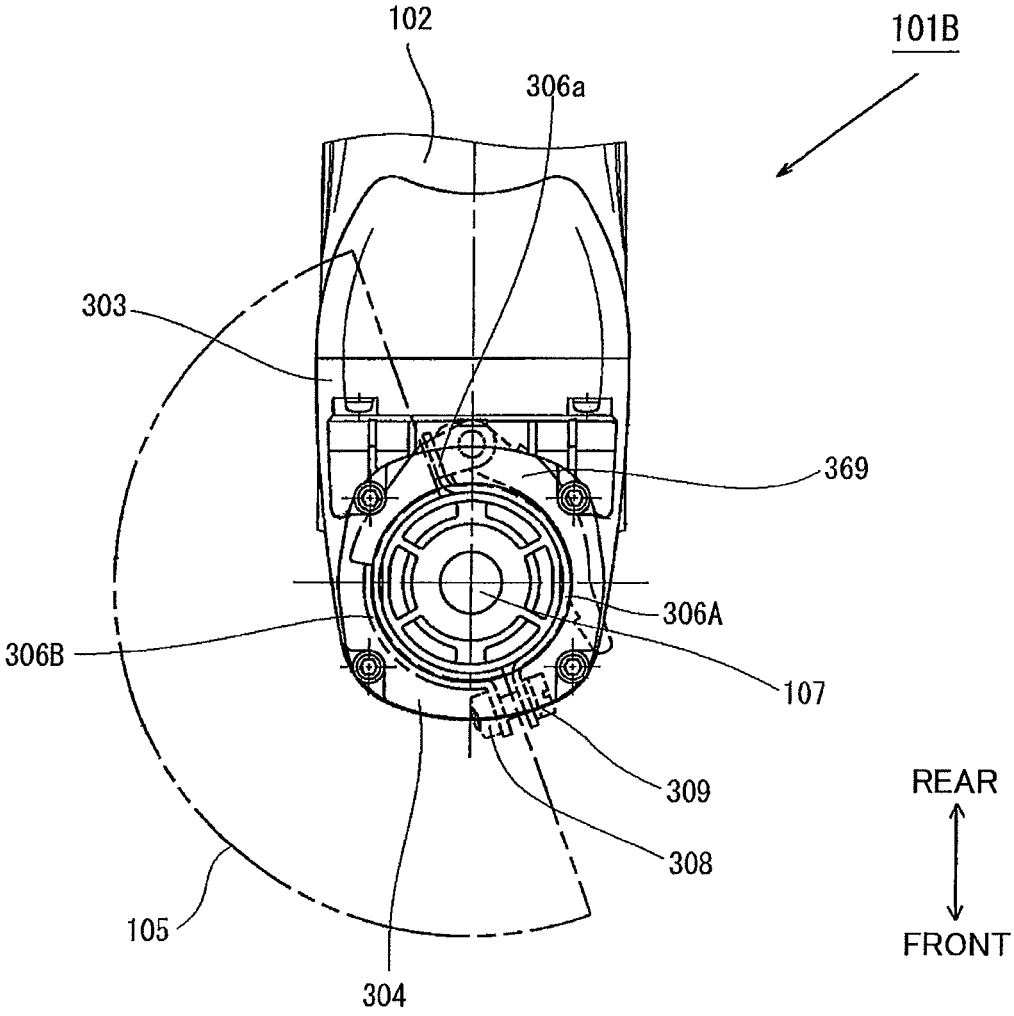
FIG.4 Related Art
FIG. 4 is a partial bottom view of still another conventional disc grinder.

Disc grinders according to embodiments of the invention will be described while referring to the accompanying drawings wherein like parts and components are designated by the same reference numerals to avoid duplicating description.

The terms "up," "down," "upper," "lower," "above," "right," "left," "front," "rear" and the like will be used throughout the description assuming that a disc grinder is disposed in an orientation in which it is intended to be used. In use, the disc grinder is disposed as shown in FIGS. 5 and 6.

First Embodiment

A disc grinder 1 according to a first embodiment of the invention will be described with reference to FIGS. 5 to 9.

Figure 5:
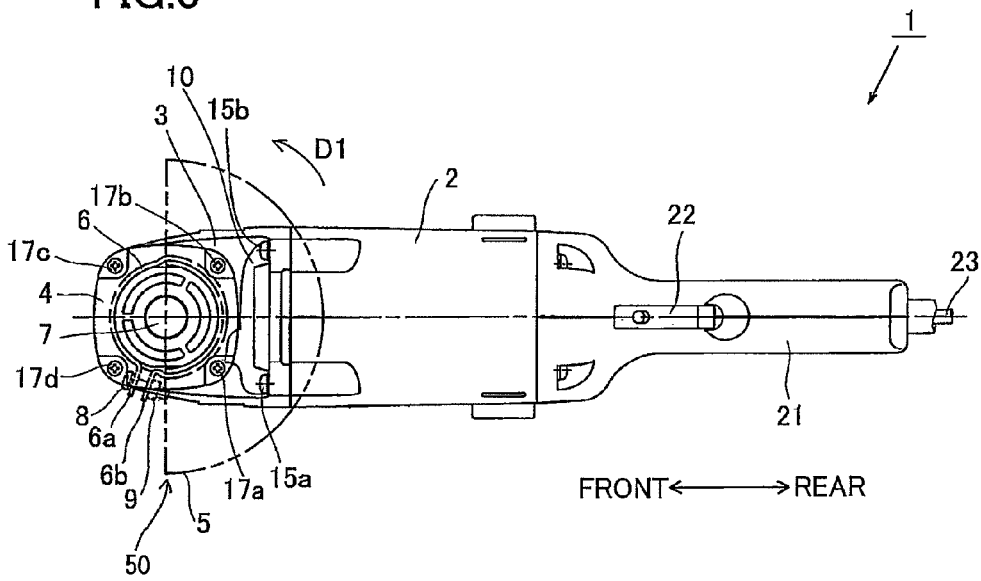
FIG. 5 is a bottom view of a disc grinder according to a first embodiment of the invention.
Figure 6:
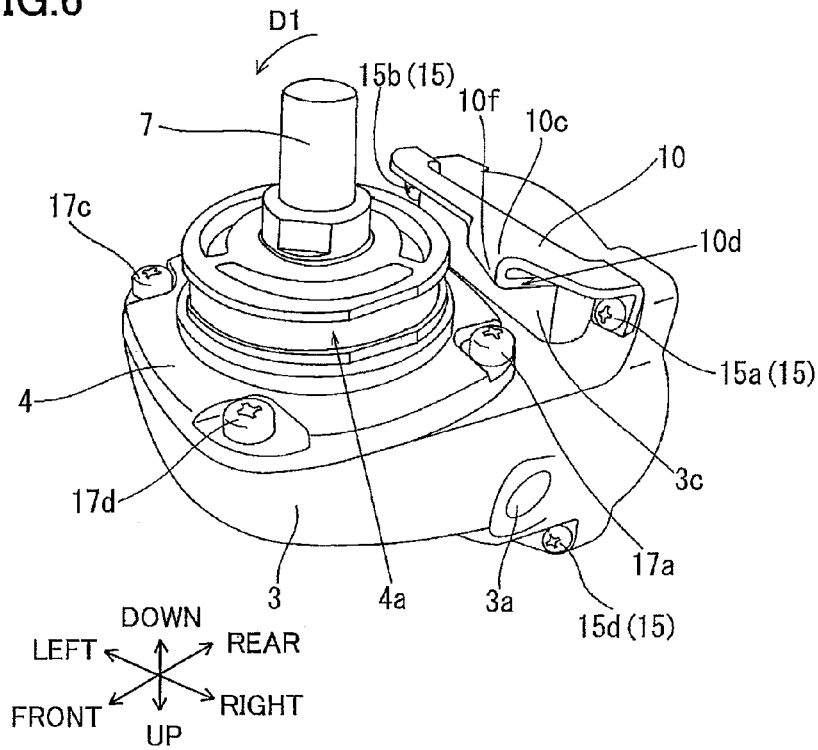
FIG. 6 is a perspective partial view of the disc grinder with a wheel guard removed, according to the first embodiment of the invention.

As shown in FIG. 5, the disc grinder 1 includes a motor housing 2, a handle housing 21, and a gear cover 3. Although not shown in the drawings, the motor housing 2 accommodates a motor having a rotary shaft extending in a front-rear direction. The handle housing 21 is attached to a rear section of the motor housing 2, and is provided with a power code 23 extending outward and a power switch 22 for turning ON/OFF the power to the disc grinder 1.

Figure 7:
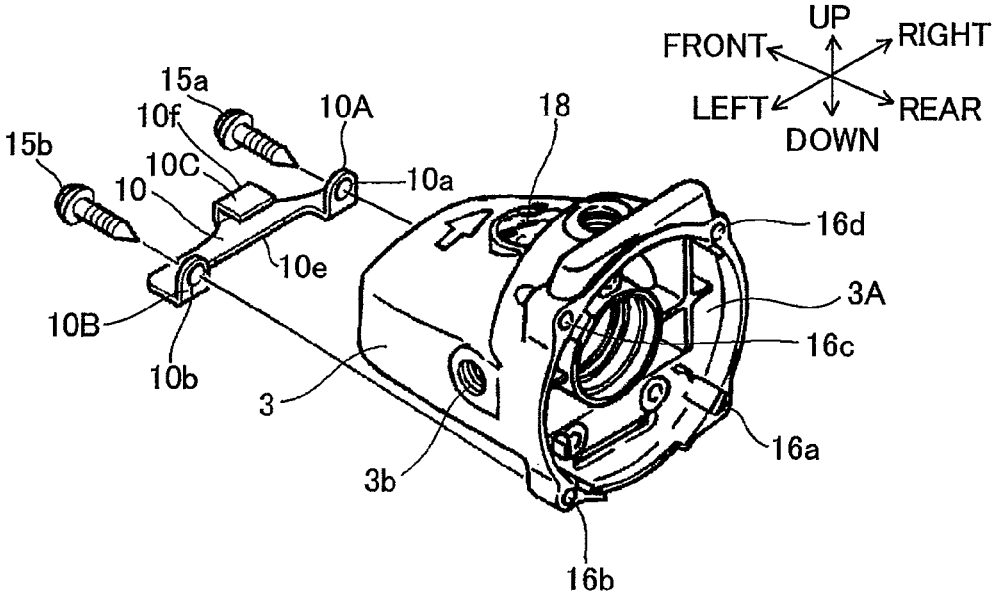
FIG. 7 is an exploded perspective view of a gear cover and a stop piece of the disc grinder according to the first embodiment of the invention.

The gear cover 3 has the same configuration as conventional gear covers, and is integrally formed of aluminum alloy, for example. As shown in FIG. 7, the gear cover 3 is formed with four screw holes 16*a*, 16*b*, 16*c*, and 16*d* at a rear periphery defining an rear opening 3A, and is fixed to a front section of the motor housing 2 by four screws 15 (FIG. 6) inserted through the screw holes 16*a*, 16*b*, 16*c*, and 16*d* in the front-rear direction, i.e., in a direction parallel to the rotary shaft of the motor. The screws 15 include screws 15*a*, 15*b*, and 15*d* shown in FIG. 6 and another screw not shown in the drawings.

As shown in FIG. 6, the disc grinder 1 also includes a spindle case 4 and a spindle 7. The spindle case 4 is integrally made of such metal as aluminum, and is attached to the gear cover 3 by four screws 17*a*, 17*b*, 17*c*, and 17*d* (FIG. 5). Note that the gear cover 3 and the spindle case 4 together function as a gear housing. The spindle 7 is rotatably supported to the spindle case 4 and extends downward from the spindle case 4. The spindle case 4 is formed with four screw holes (not shown) for receiving the screws 17*a*, 17*b*, 17*c*, and 17*d* at positions around the spindle 7. The spindle case 4 has a column part 4*a* at a position near the center of the spindle case 4 in an up-down direction, which is parallel to an axial direction of the spindle 7. The column part 4*a* has a surface having a certain width in the up-down direction and continuous in the circumferential direction.

Although not shown in the drawings, the gear cover 3 accommodates a gear mechanism for transmitting a driving force of the motor to the spindle 7. The gear mechanism includes a bevel gear attached to the rotary shaft of the motor and another bevel gear attached to an upper end of the spindle 7 for reducing the rotation speed of the driving force and changing a power transmission direction by about 90 degrees. The spindle 7 functions as an output shaft, and such a tool bit as a disc-shaped grindstone is attached to a lower end of the spindle 7. With this configuration, the tool bit is rotated together with the spindle 7 in a counterclockwise direction D1 about a rotary shaft of the spindle 7 extending in the up-down direction. As shown in FIG. 7, the gear cover 3 is also provided with a spindle lock 18 for preventing idle rotation of the spindle 7 when attachment of the tool bit.

As shown in FIGS. 6 and 7, the gear cover 3 is formed at right and left sides thereof with a pair of screw holes 3*a* and 3*b* for receiving screws (not shown) by which a handle (not shown) is attached to the gear cover 3. The gear cover 3 is also formed with a protrusion 3*c* (FIG. 6) protruding frontward from a rear section of the gear cover 3.

Figure 8:
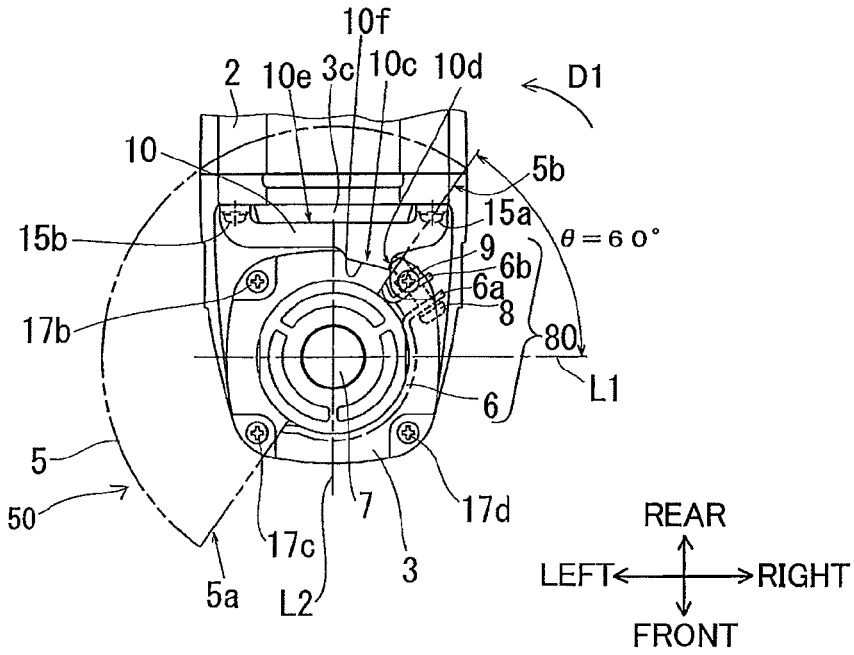
FIG. 8 is a partial bottom view of the disc grinder according to the first embodiment of the invention.

As shown in FIG. 8, the disc grinder 1 also includes a wheel guard 50 having a guard member 5 and a fastening unit 80. The wheel guard 50 is for preventing grinding dust and other dirt from scattering toward an operator during cutting operations. The guard member 5 is in a semicircular shape having edges 5*a* and 5*b*, and covers approximately a half of the disc-shaped tool bit on the operator side.

The wheel guard 50 is mounted on the column part 4*a* of the spindle case 4 so as to be rotatable with respect to the spindle case 4 about the rotary axis of the spindle 7. In grinding operations, the wheel guard 50 is fixed at a position by the fastening unit 80. That is, the fastening unit 80 selectively fixes and unfixes the wheel guard 50 to and from the spindle case 4. The fastening unit 80 includes a fastening ring 6, a screw 8, and a nut 9. The fastening ring 6 is fixed to or integrally formed with the guard member 5, and is formed with a pair of bending parts 6*a* and 6*b* at edges. The screw 8 is inserted through screw holes formed in the bending parts 6*a* and 6*b*, and engages with the nut 9. In order to adjust the position of the wheel guard 50, an operator first unscrews the screw 8 to loosen the fastening of the fastening ring 6, rotates the wheel guard 50 around the column part 4*a* of the spindle case 4 to a desired position, and then tightens the screw 8 to fasten the fastening ring 6. At a result, the wheel guard 50 is fixed at the desired position.

As shown in FIGS. 6 and 7, the disc grinder 1 also includes a stop piece 10 that functions as a rotation-regulation mechanism for regulating rotation of the wheel guard 50. The stop piece 10 is fixed to the gear cover 3 by the screws 15*a* and 15*b*, which are lower two of the four screws 15 for fixing the gear cover 3 to the motor housing 2. That is, the screws 15*a* and 15*b* fix the stop piece 10 to the motor housing 2 together with the gear cover 3.

The stop piece 10 is formed by pressing such metal plate as a cold rolled steel (SPCC) plate, for example. As shown in FIG. 7, the stop piece 10 has bending parts 10A and 10B formed with screw holes 10*a* (fixing section) and 10*b* (reaction-force receiving section) for receiving the screws 15*a* and 15*b*, respectively. The stop piece 10 also has a bending part 10C formed by bending a protrusion located near the center of the stop piece 10 in the right-left direction. As shown in FIG. 6, the bending part 10C has a front surface 10*f* and an abutting section 10*d*.

The shape and bending position of the bending part 10C are determined such that the abutting section 10*d* can abut the screw 8 as shown in FIG. 8. More specifically, the bending part 10C is formed such that the front surface 10*f* extends along the fastening ring 6 in a direction diagonal to the line L1 extending in the right-left direction perpendicular to an axial line L2 of the motor, and such that a tip end of the screw 8 comes into abutment with the abutting section 10*d* when the wheel guard 50 is rotated in the counterclockwise direction D1 to a predetermined position, which is where the edge 5*b* of the guard member 5 extends in a direction 60 degrees with respect to the line L1 as shown in FIG. 8 in this embodiment. That is, the abutting section 10*d* functions as a stopper that contacts the tip end of the screw 8, thereby preventing the wheel guard 50 from rotating more than 60 degrees beyond the position shown in FIG. 8. As shown in FIG. 7, the stop piece 10 is also formed with a recess 10*e* for engaging with the protrusion 3*c* (FIG. 6) of the gear cover 3. Thus, the stop piece 10 can easily be positioned with respect to the gear cover 3.

Assuming that the operator is performing grinding operations with the wheel guard 50 fixed at a position of θ=less than 60 degrees where the fastening unit 80 is out of contact with the bending part 10C of the stop piece 10, if rotation force generated for some reason during grinding operations rotates the wheel guard 50 in the counterclockwise direction D1 which is a rotation direction of the tool bit (not shown), then the tip end of the screw 8 comes into abutment with the abutting section 10*d* of the stop piece 10 at the position of θ=60 degrees, thereby stopping the rotation of the wheel guard 50. Thus, even if the wheel guard 50 accidentally comes free from a fixed position during operation by loose of the screw 8 or bumping on the wheel guard 50 and rotates in the counterclockwise direction D1, the wheel guard 50 is prevented from rotating beyond the position of θ=60 degrees. Thus, a rear section of the tool bit on the operator side remains covered by the wheel guard 50. This prevents grinding dust and other dirt from scattering toward the operator.

Figure 9:
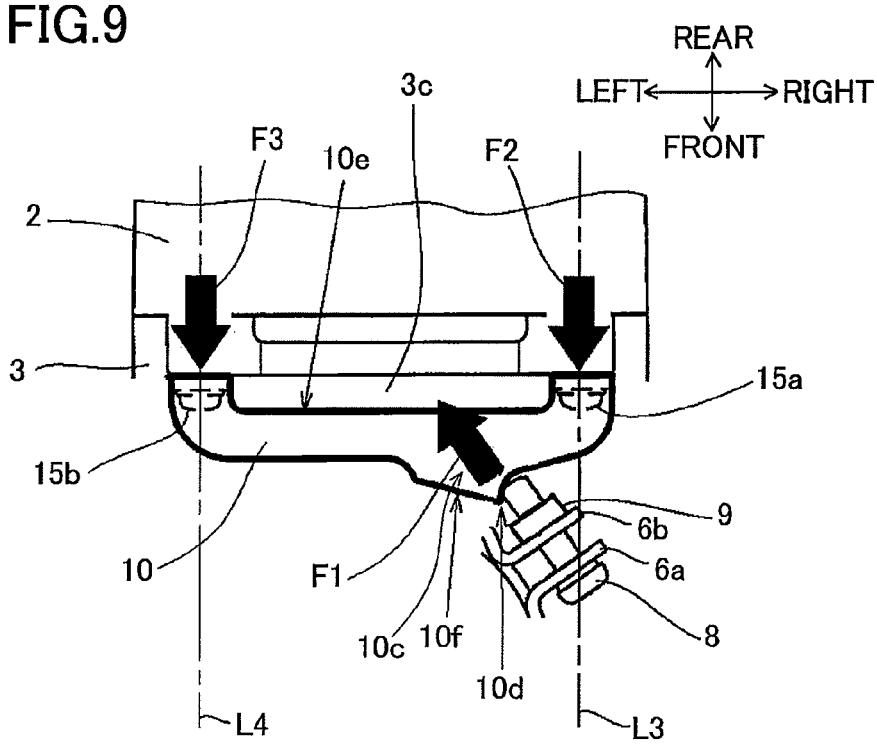
FIG. 9 is an explanatory view indicating forces exerted on the stop piece according to the first embodiment of the invention.

When the tip end of the screw 8 comes into abutment with the abutting section 10*d* of the stop piece 10, as shown in FIG. 9, a relatively large force F1 is applied to the stop piece 10, and reaction forces F2 and F3 are generated in the stop piece 10 mainly at the screws 15*a* and 15*b* having relatively strong strength. Also, the abutting section 10*d*, i.e., a section of the stop piece 10 where the force F1 is applied to, is between axial lines L3 and L4 of the screws 15*a* and 15*b* with respect to the right-left direction, i.e., out of alignment with the axial lines L3 and L4. This configuration hardly generates a rotational force to the stop piece 10. Thus, rotation of the stop piece 10 can be prevented. Further, if the recess 10*e* of the stop piece 10 is arranged so that the protrusion 3*c* of the gear cover 3 is well fit in the recess 10*e*, a reaction force is also generated at the protrusion 3*c*.

Because the abutting section 10*d* is located at a position deviated from the axial line L3 of the screw 15*a*, the screw 8 can easily abut the abutting part 10*d*. Also, because the abutting section 10*d* is located on the spindle side of the axial line L3 with respect to the right-left direction, the length of the abutting section 10*d* in the right-left direction can be shortened, and an amount of the abutting section 10*d* protruding in the right-left direction beyond the gear cover 3 can be minimized.

As described above, according to the present embodiment, the reaction forces F2 and F3 are generated at the screws 15*a* and 15*b*, and the abutting section 10*d* is out of alignment with the axial lines L3 and L4 of the screws 15*a* and 15*b*. Thus, it is unnecessary to make the stop piece 10 firmer nor to make the screws 15*a* and 15*b* thicker than conventional one. Thus, it is possible to realize a means for regulating rotation of the wheel guard 50 by simply attaching the stop piece 10 to the gear cover 3 by the screws 15*a* and 15*b* without modifying the conventional configuration of the gear cover 3 or the motor housing 2. That is, the means for regulating rotation of the wheel guard 50 can be realized by only adding the stop piece 10 having a simple configuration.

Because the stop piece 10 is formed by pressing a metal plate, the stop piece 10 can be manufactured at low cost. Also, because the abutting section 10*d* is located between the screws 15*a* and 15*b* in the right-left direction, the force F1 exerted on the abutting section 10*d* is dispersed between and received by the screws 15*a* and 15*b*.

Note that in this embodiment the abutting section 10*d* is configured to contact the tip end of the screw 8, but the abutting section 10*d* may contact any other part of the fastening unit 80, such as the nut 9, the bending part 6*a* or 6*b*, a protrusion formed to the fastening ring 6. Also, an additional protrusion or an additional abutting section may be formed to the fastening ring 6 or the guard member 5 for abutting the abutting section 10*d*, although this configuration increases production costs. Note that the screw 8, the nut 9, and the bending parts 6*a* and 6*b* of the fastening ring 6 together function as a protruding section of the fastening unit 80 in this embodiment.

Further, the rotation range of the wheel guard 50 is regulated within 60 degrees in this embodiment, but the rotation range of the wheel guard 50 may be changed arbitrarily by arranging the position and shape of the bending part 10C of the stop piece 10 in accordance with the type of wheel guard 50.

Second Embodiment

Next, a disc grinder 1A according to a second embodiment of the invention will be described with reference to FIGS. 10 to 12.

Figure 10:
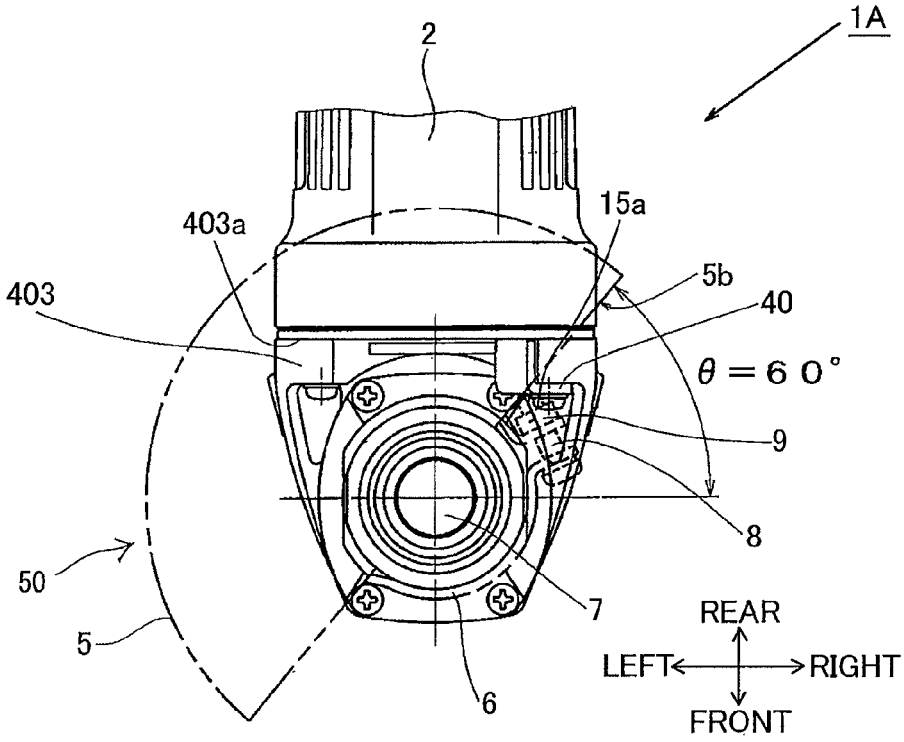
FIG. 10 is a partial bottom view of a disc grinder according to a second embodiment of the invention.
Figure 11:
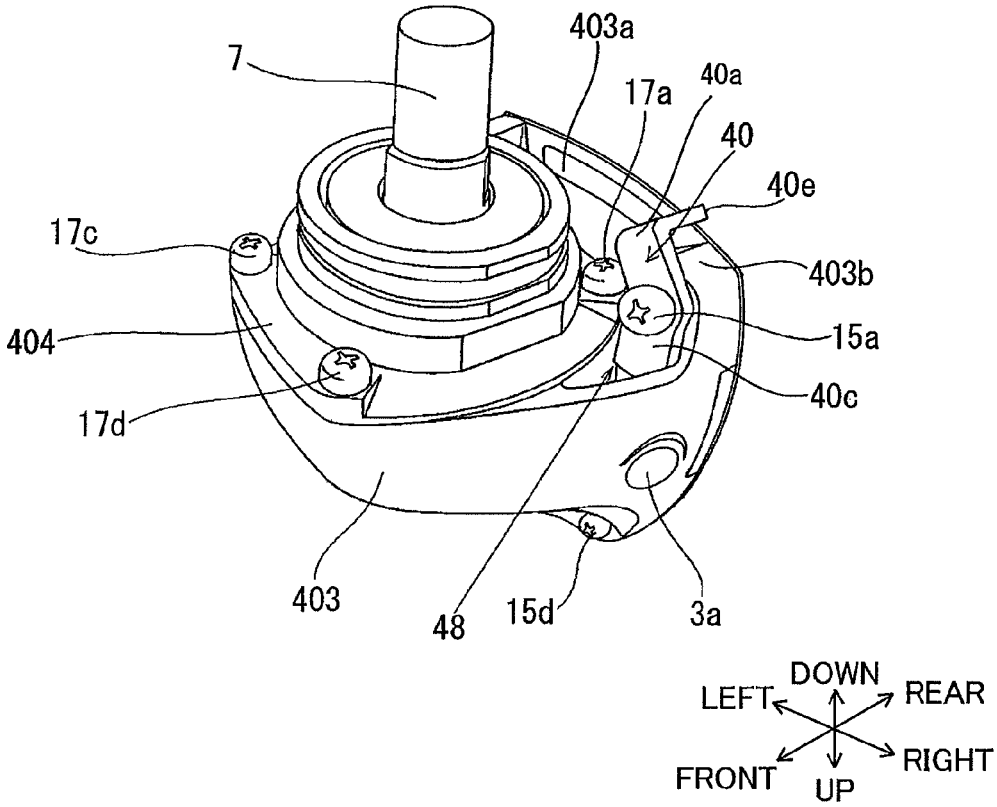
FIG. 11 is a partial perspective view of the disc grinder with a wheel guard removed, according to the second embodiment of the invention.

As shown in FIGS. 10 and 11, the disc grinder 1A has a stop piece 40 that is fixed to a gear cover 403 by the single screw 15*a*. The stop piece 40 is made by pressing a metal plate. As shown in FIG. 11, the gear cover 403 has a surface 403*a* facing frontward, and is formed with a recess 48 on a lower surface thereof. The gear cover 403 is also formed with a screw boss 403*b* on the surface 403*a*. The screw boss 403*b* has a certain length in the front-rear direction, and is formed at the center with a screw hole for receiving the screw 15*a*. A wall of the screw boss 403*b* defining the screw hole has a certain thickness.

Figure 12:
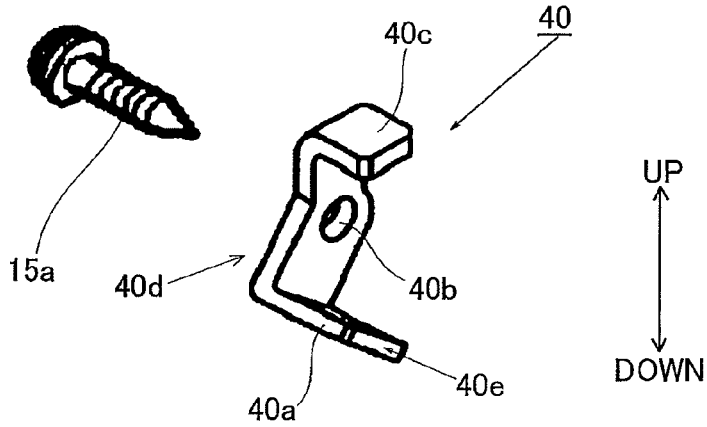
FIG. 12 is a perspective view of a stop piece of the disc grinder according to the second embodiment of the invention.

As shown in FIG. 12, the stop piece 40 has a lower bending part 40*a* and an upper bending part 40*c* formed continuously with the lower bending part 40*a*, and is formed with a through hole (fixing section) 40*b* at a conjunction between the bending parts 40*a* and 40*c* for receiving the screw 15*a*. The upper bending part 40*c* is formed in a shape that follows a contour of the recess 48 (FIG. 11) formed in the gear cover 403. When the stop piece 40 is fixed to the gear cover 403 as shown in FIG. 11, the upper bending part 40*c* is received in the recess 48 and contacts an upper surface of the screw boss 403*b*, and an end face 40*e* (reaction-force receiving section) of the lower bending part 40*a* contacts the surface 403*a* of the gear cover 403.

As shown in FIG. 10, when the wheel guard 50 is rotated in the counterclockwise direction to a position of θ=60 degrees, the tip end of the screw 8 comes into abutment with a flat section (abutting section) 40*d* of the stop piece 40 (FIG. 12) located below the through hole 40*b*.

Because the upper bending part 40*c* of the stop piece 40 is fitted in the recess 48 of the gear cover 403, the stop piece 40 can be prevented from rotating about the screw 15*a* although the stop piece 40 is only fixed by the single screw 15*a*, and also can well resist a force applied thereto in a direction diagonal to an axial direction of the screw 15*a*. Further, because the end face 40*e* of the stop piece 40 contacts the surface 403*a* of the gear cover 403, even when the tip end of the screw 8 bumps against the stop piece 40, the gear cover 403 can receive the bumping force.

The recess 48 also functions as an exhaust opening for discharging cooling air having cooled the motor, and the air discharged through the recess 48 can cool the stop piece 40. Here, if the stop piece 40 is constantly or repeatedly exerted with a force and heated by friction heat generated upon bumping against the screw 8, durability of the stop piece 40 is reduced. However, cooling the stop piece 40 with the air improves the durability of the stop piece 40.

According to this embodiment, as shown in FIG. 10, when the wheel guard 50 reaches the position of 0=about 60 degrees, the tip end of the screw 8 abuts the flat section 40*d* of the stop piece 40, thereby preventing the wheel guard 50 from further rotating beyond this position.

This configuration can be realized by simply adding the stop piece 40 to be attached by the single screw 15*a* without changing the conventional configuration of the gear cover 403 or the motor housing 2. Also, because the upper bending part 40*c* of the stop piece 40 is received in the recess 48 of the gear cover 403, although the stop piece 40 is fixed to the gear cover 403 by only the single screw 15*a*, a rotation-regulation mechanism can have sufficient rigidity.

Because the stop piece 40 is attached to the gear cover 403 by the single screw 15*a*, the stop piece 40 can be attached to a gear cover having limited space for the stop piece 40. Also, because the flat section 40*d* is located between the screw 15*a* and the end face 40*e* as shown in FIG. 11, the force exerted on the flat section 40*d* can be dispersed between and absorbed by the screw 15*a* and the end face 40*e*. Moreover, because the flat section 40*d* is deviated from the axial line L3 in a radial direction of the screw hole 40*b*, the wheel guard 50 is prevented from bumping against the screw 15*a*.

Third Embodiment

Figure 13:
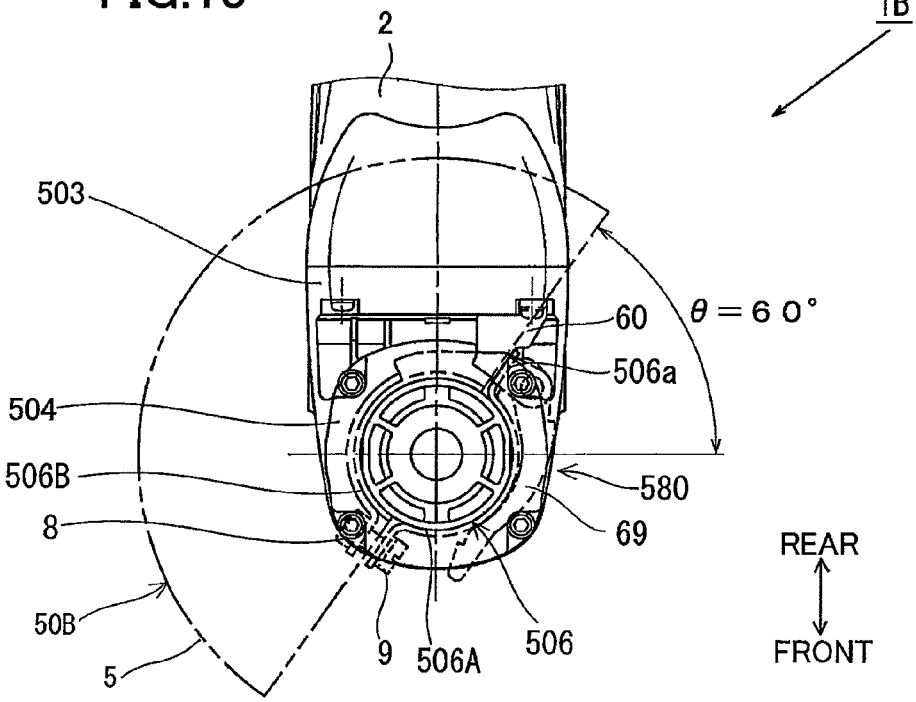
FIG. 13 is a partial bottom view of a disc grinder according to a third embodiment of the invention.

Next, a disc grinder 1B according to a third embodiment of the invention will be described with reference to FIGS. 13 to 16. As shown in FIG. 13, the disc grinder 1B includes a wheel guard 50B having the guard member 5 and a fastening unit 580 for fixing the wheel guard 50B to a spindle case 504. The fastening unit 580 includes a lever 69 and a fastening ring 506 divided into a pair of ring members 506A and 506B, in addition to the screw 8 and the nut 9. The ring member 506B is fixed to or integrally formed with the guard member 5. One end of each ring members 506A and 506B at one side is bent to form a bending edge. The screw 8 and the nut 9 together connect the pair of bending edges of the ring members 506A and 506B. The fastening unit 580 also includes a fingertip fastening mechanism that connects and separates a bending edge 506*a* of the ring member 506A at the other end to and from the other end of the ring member 506B when the lever 69 is operated. With this configuration, when the lever 69 is moved in a radial direction of the wheel guard 50B, the fastening of the fastening ring 506 to the spindle case 504 is loosened, so the wheel guard 50B becomes rotatable with respect to the spindle case 504. In this manner, the operator can move the wheel guard 50B to a desired position with respect to the spindle case 504 in accordance with the operator's working posture and the like.

Figure 14:
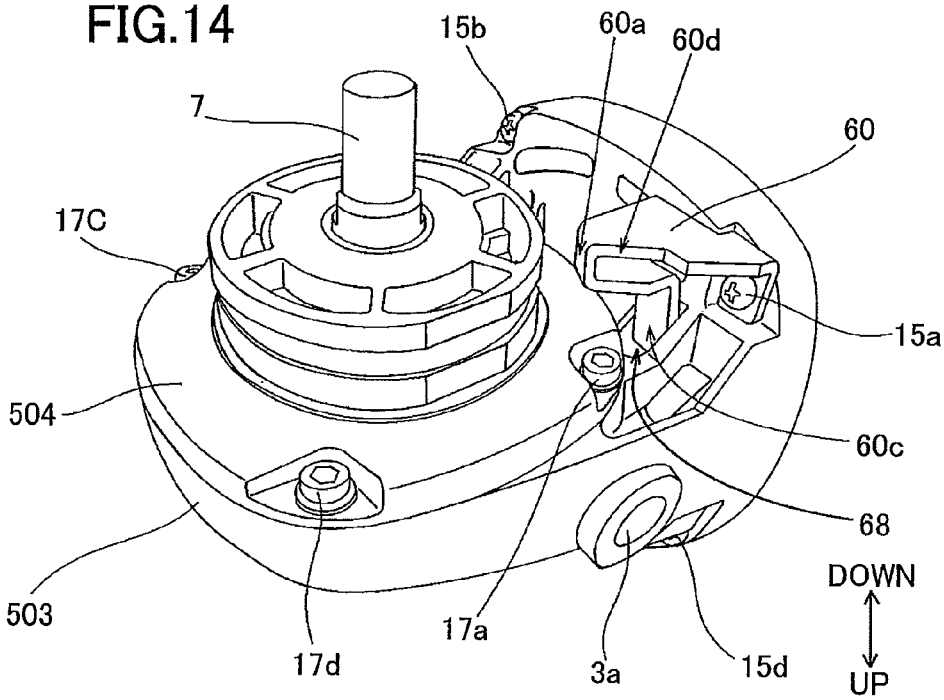
FIG. 14 is a partial perspective view of the disc grinder with a wheel guard removed, according to the third embodiment of the invention.
Figure 15:
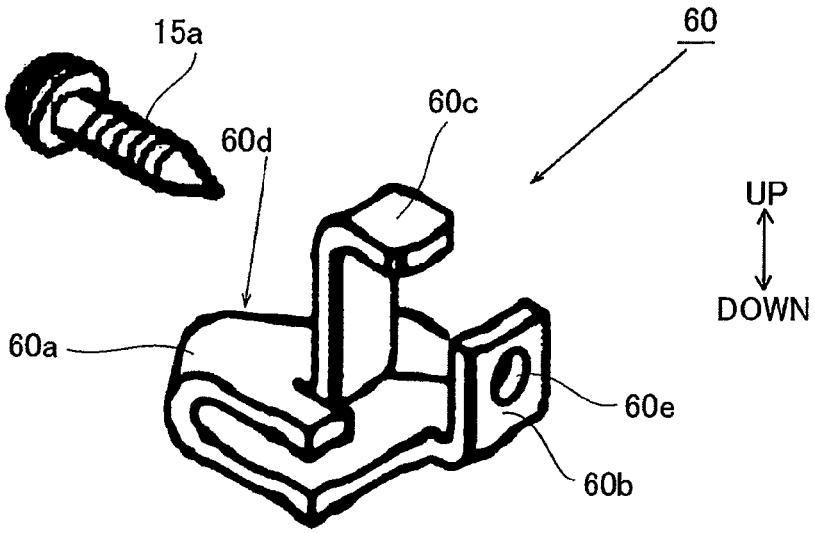
FIG. 15 is a perspective view of a stop piece of the disc grinder according to the third embodiment of the invention.

As shown in FIG. 14, the disc grinder 1B also includes a stop piece 60 fixed to a gear cover 503 by the single screw 15*a*. The stop piece 60 is formed by pressing a metal plate. As shown in FIG. 15, the stop piece 60 is formed with a bending part 60*a* having a side surface (abutting section) 60*d*, a bending part 60*b* formed continuous with one end of the bending part 60*a*, and a claw 60*c* (reaction-force receiving section) formed continuous with the other end of the bending part 60*a*. The bending part 60*b* is formed with a screw hole (fixing section) 60*e* through which the screw 15*a* is inserted.

As shown in FIG. 14, the gear cover 503 is formed with a recess 68 on a lower surface thereof. When the stop piece 60 is fixed to the gear cover 503 (to the motor housing 2 together with the gear cover 503) by the screw 15*a*, the claw 60*c* is received in the recess 68 and contacts a wall of the recess 68. Thus, although the stop piece 60 is only fixed to the gear cover 503 by the screw 15*a*, the stop piece 60 is prevented from rotating about the screw 15*a*. Also, because the claw 60*c* is formed to have a sufficient thickness, sufficient rigidity of the stop piece 60 is ensured.

With this configuration, when the wheel guard 50B is rotated in the counterclockwise direction to a position of θ=60 degrees as shown in FIG. 13, the bending edge 506*a* of the fastening ring 506 abuts the side surface 60*d* of the stop piece 60, thereby preventing the wheel guard 50B from rotating further beyond this position.

Figure 16:
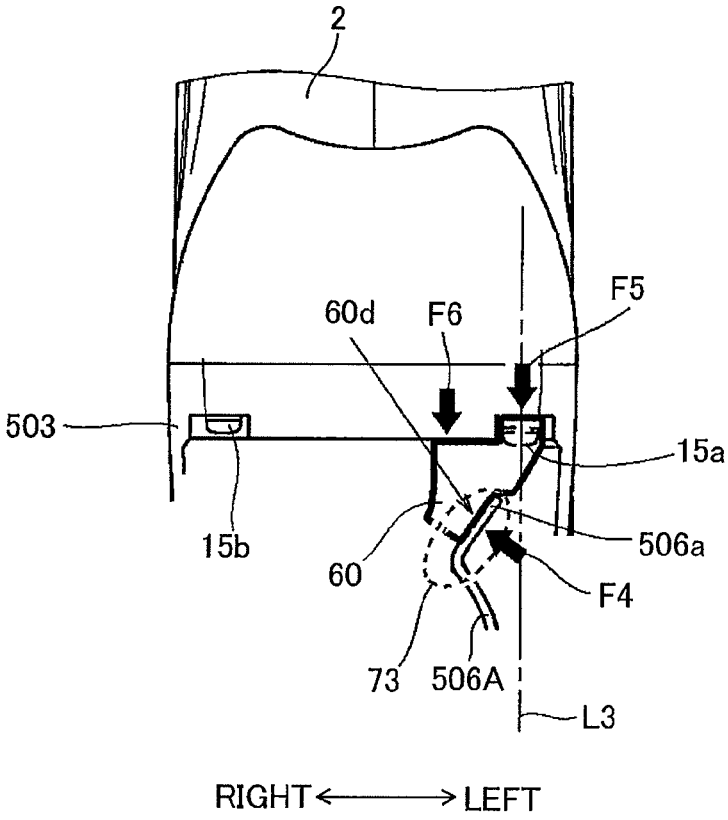
FIG. 16 is an explanatory view showing forces exerted on the stop piece according to the third embodiment of the invention.

As shown in FIG. 16, when the bending edge 506*a* of the fastening ring 506 abuts the side surface 60*d* of the stop piece 60, a strong force F4 is exerted on the stop piece 60. Because the side surface 60*d* is located between the screw 15*a* and the claw 60*c* (FIG. 15) of the stop piece 60, the force F4 is dispersed between and received by the screw 15*a* and the claw 60*c*. In other words, reaction forces F5 and F6 are generated respectively at the screw 15*a* and at a section of the claw 60*c* of the stop piece 60 in abutment with the wall of the recess 68. Also, because the position (a contact region 73) where the bending edge 506*a* contacts the stop piece 60 is biased toward the axial line of the motor (rightward) from the axial line L3 of the screw 15*a*, and because the side surface 60*d* of the stop piece 60 is on the right side of the line L3 (on the same side as the spindle 7 in the right-left direction), rotation of the contact piece 60 upon abutment with the bending edge 506*a* is prevented.

In this embodiment also, the because the side surface 60*d* is deviated from the axial line L3 in a radial direction of the screw hole 60*e*, the wheel guard 50B is prevented from bumping against the screw 15*a*.

The recess 68 also functions as an exhaust opening for discharging cooling air having cooled the motor, and the air discharged through the recess 68 can cool the stop piece 60. Thus, even if the stop piece 60 is constantly or repeatedly exerted with the force F4, cooling the stop piece 60 with the air improves durability of the stop piece 60.

The above-described configuration of this embodiment can be realized by simply adding the stop piece 60 to only be attached by the screw 15*a* without changing the conventional configuration of the gear cover 503 or the motor housing 2. Also, because the claw 60*c* of the stop piece 60 is received in the recess 68 of the gear cover 503, although the stop piece 60 is fixed to the gear cover 503 by only the single screw 15*a*, a rotation-regulation mechanism of this embodiment can have sufficient rigidity.

While the invention has been described in detail with reference to the embodiments thereof, it would be apparent to those skilled in the art that various changes and modifications may be made therein without departing from the spirit of the invention.

For example, the stop pieces 10, 40, and 60 are formed of metal plates in the above-described embodiments. However, the stop pieces 10, 40, and 60 may be formed in different methods, such as molding or synthetic resin molding. Also, the stop pieces 10, 40, and 60 may be formed integrally with the gear covers 3, 403, and 503, respectively. Further, without using the stop piece 10, 40, or 60, a protrusion may be formed to an outer wall of the gear cover 3, 403, or 503 for regulating rotation of the wheel guard 50, 50B.

What is claimed is:

1. A grinder comprising:

a housing for accommodating a motor;

a gear cover attached to the housing by a plurality of screws extending in a first direction;

a spindle case attached to the gear cover;

a spindle extending outward from the spindle case in a second direction perpendicular to the first direction;

a wheel guard rotatably mounted on the spindle case for covering approximately a first half of a disc-shaped tool bit attached to the spindle, the wheel guard being selectively fixed to and unfixed from the spindle case, a remaining half of the disc-shaped tool being positioned farther from the housing than the first half from the housing; and a stop piece that regulates the rotation of the wheel guard, wherein:

the stop piece is fixed to the housing together with the gear cover by at least one of the plurality of screws;

the stop piece has an abutting section at which the stop piece abuts the wheel guard to regulate the rotation of the wheel guard, the abutting section being located at a position deviated from an axial line of the at least one of the plurality of screws that is extending in the first direction; and the wheel guard further comprises a fastening unit configured to restrict the rotation of the wheel guard at a predetermined angular position when the stop piece abuts the wheel guard, the fastening unit being configured to fix the wheel guard to the gear cover at any angular position until the predetermined angular position.

2. The grinder according to claim 1, wherein:

the spindle case has a column-shaped part;

the wheel guard includes a fastening unit that selectively fixes and unfixes the wheel guard to and from an outer periphery of the column-shaped part of the spindle case; and the abutting section abuts the fastening unit of the wheel guard.

3. The grinder according to claim 2, wherein:

the wheel guard also includes a guard member;

the fastening unit includes a fastening ring fixed to the guard member, and is formed with a protruding section protruding outward in a radial direction of the fastening ring; and the abutting section abuts the protruding section of the fastening unit.

4. A grinder comprising:

a housing for accommodating a motor;

a gear cover attached to the housing by a plurality of screws extending in a first direction;

a spindle case attached to the gear cover, the spindle case having a column-shaped part;

a spindle extending outward from the spindle case in a second direction perpendicular to the first direction;

a wheel guard rotatably mounted on the spindle case for covering approximately a half of a disc-shaped tool bit attached to the spindle, the wheel guard being selectively fixed to and unfixed from the spindle case, the wheel guard including a fastening unit that selectively fixes and unfixes the wheel guard to and from an outer periphery of the column-shaped part of the spindle case, the wheel guard including a guard member; and a stop piece that regulates the rotation of the wheel guard, wherein:

the stop piece is fixed to the housing together with the gear cover by at least one of the plurality of screws;

the stop piece has an abutting section at which the stop piece abuts the wheel guard to regulate the rotation of the wheel guard, the abutting section being located at a position deviated from an axial line of the at least one of the plurality of screws that is extending in the first direction;

the abutting section abuts the fastening unit of the wheel guard;

the fastening unit includes a fastening ring fixed to the guard member, and is formed with a protruding section protruding outward in a radial direction of the fastening ring;

the abutting section abuts the protruding section of the fastening unit; and the protruding section includes a screw and bending parts formed at both ends of the fastening ring and formed with screw holes through which the screw is inserted, and the abutting section abuts the screw.

5. A grinder comprising:

a housing for accommodating a motor;

a gear cover attached to the housing by a plurality of screws extending in a first direction;

a spindle case attached to the gear cover, the spindle case having a column-shaped part;

a spindle extending outward from the spindle case in a second direction perpendicular to the first direction;

a wheel guard rotatably mounted on the spindle case for covering approximately a half of a disc-shaped tool bit attached to the spindle, the wheel guard being selectively fixed to and unfixed from the spindle case, the wheel guard including a fastening unit that selectively fixes and unfixes the wheel guard to and from an outer periphery of the column-shaped part of the spindle case, the wheel guard including a guard member; and a stop piece that regulates the rotation of the wheel guard, wherein:

the stop piece is fixed to the housing together with the gear cover by at least one of the plurality of screws;

the stop piece has an abutting section at which the stop piece abuts the wheel guard to regulate the rotation of the wheel guard, the abutting section being located at a position deviated from an axial line of the at least one of the plurality of screws that is extending in the first direction;

the abutting section abuts the fastening unit of the wheel guard;

the fastening unit includes a fastening ring fixed to the guard member, and is formed with a protruding section protruding outward in a radial direction of the fastening ring;

the abutting section abuts the protruding section of the fastening unit; and the protruding section includes a screw and bending parts formed at both ends of the fastening ring and formed with screw holes through which the screw is inserted, and the abutting section abuts one of the bending parts.

6. The grinder according to claim 3, wherein the fastening ring includes a plurality of ring members, one of which is bent at one end to form a protrusion, and the protruding section is the protrusion.

7. A grinder comprising:

a housing for accommodating a motor;

a gear cover attached to the housing by a plurality of screws extending in a first direction;

a spindle case attached to the gear cover;

a spindle extending outward from the spindle case in a second direction perpendicular to the first direction;

a wheel guard rotatably mounted on the spindle case for covering approximately a half of a disc-shaped tool bit attached to the spindle, the wheel guard being selectively fixed to and unfixed from the spindle case; and a stop piece that regulates the rotation of the wheel guard, wherein:

the stop piece is fixed to the housing together with the gear cover by at least one of the plurality of screws;

the stop piece has an abutting section at which the stop piece abuts the wheel guard to regulate the rotation of the wheel guard, the abutting section being located at a position deviated from an axial line of the at least one of the plurality of screws that is extending in the first direction; and the stop piece is fixed to the housing together with the gear cover by two of the plurality of screws;

the stop piece is fixed to the housing together with the gear cover by two of the plurality of screws.

8. The grinder according to claim 7, wherein the stop piece is formed by pressing a metal plate, and the abutting section is located between the two of the plurality of screws.

9. The grinder according to claim 1, wherein the stop piece is fixed by a single screw of the plurality of screws.

10. The grinder according to claim 9, wherein the stop piece is formed with a screw hole for receiving the one of the plurality of screws, and the abutting section is located at a position deviated from the axial line of the one of the plurality of screws in a radial direction of the screw hole.

11. The grinder according to claim 1, wherein:

the housing is configured to accommodate the motor such that a rotary axis of the motor extends in the first direction; and the gear cover is configured to accommodate a gear mechanism for transmitting a driving power of the motor to the spindle while reducing a rotation speed and changing a rotation direction by 90 degrees.

12. A grinder comprising:

a housing for accommodating a motor:

a gear cover attached to one end of the housing in a first direction by a screw extending in the first direction;

a spindle case attached to the gear cover;

a spindle extending outward from the spindle case in a second direction perpendicular to the first direction;

a wheel guard rotatably mounted on the spindle case for covering approximately a first half of a disc-shaped tool bit attached to the spindle, the wheel guard being selectively fixed to and unfixed from the spindle case, a remaining half of the disc-shaped tool being positioned farther from the housing than the first half from the housing; and a stop piece attached to the gear cover by the screw, the stop piece having an abutting section, wherein:

the wheel guard comes into abutment with the abutting section of the stop piece when the wheel guard is rotated to a predetermined angular position;

the abutting section is located on a spindle side of the screw with respect to a third direction perpendicular to the first and second direction; and the wheel guard further comprises a fastening unit configured to restrict the rotation of the wheel guard at the predetermined angular position, the fastening unit being configured to fix the wheel guard to the gear cover at any angular position until the predetermined angular position.

13. A grinder comprising:

a housing for accommodating a motor;

a gear cover;

two screws that attach the gear cover to one end of the housing in a first direction, the two screws extending in the first direction;

a spindle case fixed to the gear cover;

a spindle extending outward from the spindle case in a second direction perpendicular to the first direction;

a wheel guard rotatably mounted on the spindle case for covering approximately a first half of a disc-shaped tool bit attached to the spindle, the wheel guard being selectively fixed to and unfixed from the spindle case, a remaining half of the disc-shaped tool being positioned farther from the housing than the first half from the housing; and a stop piece attached to the gear cover by the two screws and having an abutting section, wherein:

the wheel guard comes into abutment with the abutting section of the stop piece when the wheel guard is rotated to a predetermined angular position;

the two screws are aligned in a third direction perpendicular to the first and second directions; and the abutting section is located between the two screws with respect to the third direction; and the wheel guard further comprises a fastening unit configured to restrict the rotation of the wheel guard at the predetermined angular position, and the fastening unit being configured to fix the wheel guard to the gear cover at any angular position until the predetermined angular position.

14. A grinder comprising:

a housing for accommodating a motor;

a gear cover attached to one end of the housing in a first direction and formed with an exhaust opening;

a spindle case attached to the gear cover;

a spindle extending outward from the spindle case in a second direction perpendicular to the first direction;

a wheel guard rotatably mounted on the spindle case for covering approximately a first half of a disc-shaped tool bit attached to the spindle, the wheel guard being selectively fixed to and unfixed from the spindle case; and a stop piece at least partially received in the exhaust opening, wherein the stop piece has an abutting section that comes into abutment with the wheel guard when the wheel guard is rotated to a predetermined angular position; and the wheel guard further comprises a fastening unit configured to restrict the rotation of the wheel guard at the predetermined angular position, the fastening unit being configured to fix the wheel guard to the gear cover at any angular position until the predetermined angular position.

15. A grinder comprising:

a housing for accommodating a motor;

a gear cover fixed to one end of the housing in a first direction;

a spindle case attached to the gear cover;

a spindle extending outward from the spindle case in a second direction perpendicular to the first direction;

a wheel guard rotatably mounted on the spindle case for covering approximately a first half of a disc-shaped tool bit attached to the spindle, the wheel guard being selectively fixed to and unfixed from the spindle case, a remaining half of the disc-shaped tool being positioned farther from the housing than the first half from the housing; and a stop piece formed with a fixing section at which the stop piece is fixed to the gear cover, an abutting section that comes into abutment with the wheel guard when the wheel guard is rotated to a predetermined angular position, and a reaction-force receiving section that is in abutment with the gear cover, wherein the abutting section is located between the fixing section and the reaction-force receiving section with respect to a third direction perpendicular to the first and second direction; and the wheel guard further comprises a fastening unit configured to restrict the rotation of the wheel guard at the predetermined angular position, the fastening unit configured being to fix the wheel guard to the gear cover at any angular position until the predetermined angular position.

16. A grinder comprising:

a housing for accommodating a motor;

a gear housing fixed to the housing;

a spindle protruding outside the gear housing;

a wheel guard rotatably supported to the gear housing for covering approximately a first half of a disc-shaped tool bit attached to the spindle, a remaining half of the disc-shaped tool being positioned farther from the housing than the first half from the housing;

a stopper provided to the gear housing, wherein the stopper regulates rotation of the wheel guard when the wheel guard comes into abutment with the stopper; and the wheel guard further comprises a fastening unit configured to restrict the rotation of the wheel guard at a predetermined angular position when the wheel guard abuts the stopper, the fastening unit configured being to fix the wheel guard to the rear housing at any angular position until the predetermined angular position.

* * * * *